United States Patent [19]

Gudmundsson et al.

[11] Patent Number: 4,893,446

[45] Date of Patent: Jan. 16, 1990

[54] RELOCATABLE VERTICAL OR HORIZONTAL WALL SYSTEM

[76] Inventors: Edgar Gudmundsson, Vesturberg 49; Oli J. Asmundsson, 111 Reykjavik, both of Iceland, Iceland

[21] Appl. No.: 119,875

[22] Filed: Nov. 13, 1987

[51] Int. Cl.[4] ..... E04H 3/00

[52] U.S. Cl. ..... 52/238.1; 52/762; 52/481; 52/241

[58] Field of Search ..... 52/238.1, 243, 243.1, 52/127.2, 127.6, 241, 278, 281, 578, 581, 586, 593, 595, 461, 479, 481, 580, 762, 763, 779, 780, 781

[56] References Cited

U.S. PATENT DOCUMENTS

| | | | |
|---|---|---|---|
| 1,458,652 | 6/1923 | Gooding | 52/238.1 X |
| 3,429,090 | 2/1969 | Metelnick | 52/481 |
| 3,972,167 | 8/1976 | Vögeli | 52/241 X |
| 3,986,313 | 10/1976 | Nelsson | 52/481 |
| 4,016,690 | 4/1977 | Richardson | 52/238.1 |
| 4,231,205 | 11/1980 | Wendt | 52/762 X |

*Primary Examiner*—Carl D. Friedman
*Assistant Examiner*—Creighton Smith
*Attorney, Agent, or Firm*—Richard C. Litman

[57] ABSTRACT

A wall system includes a plurality of wall sections secured to one another or to fixed building structure through a peripheral framework of profile elements each having a web bounded by pairs of large and small flanges respectively defining deep and shallow grooves. The shallow grooves serve to engage and retain the edges of panels which are held against the large flanges while rigid splines are insertable within opposed deep grooves of adjacent profile element-equipped panels to interlock the plurality of wall sections. By employing various width splines, alternate spacing between wall sections is achievable and various supplemental members such as shelf brackets or trim elements may be installed over the exposed portions of the splines.

6 Claims, 7 Drawing Sheets

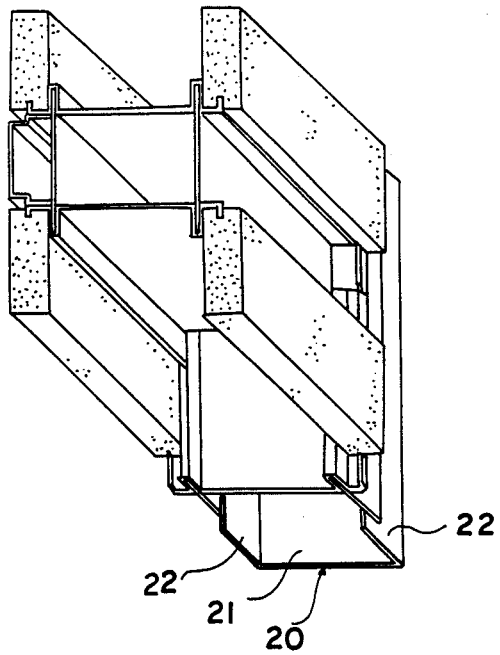
FIG. 22
FIG. 23
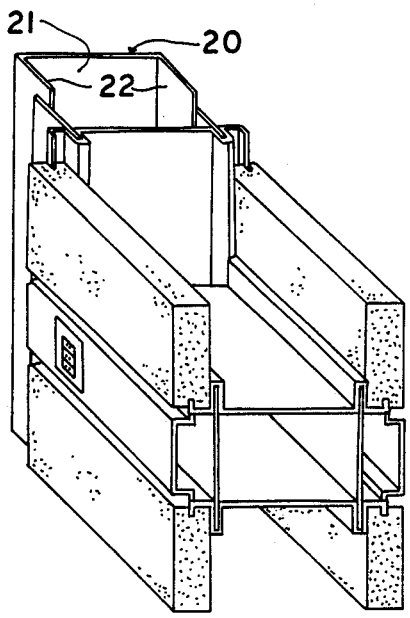
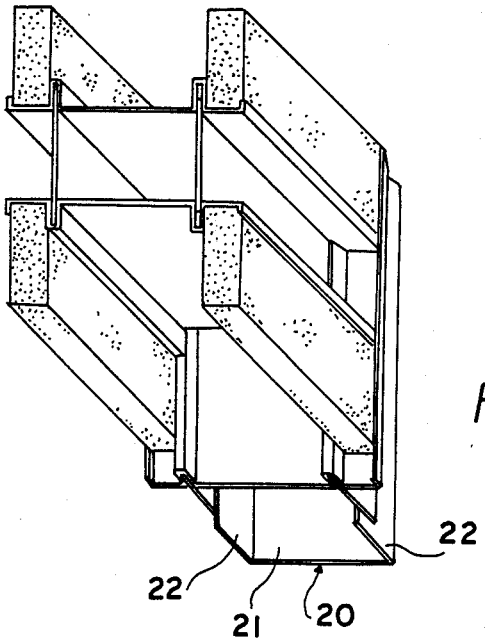
FIG. 24

RELOCATABLE VERTICAL OR HORIZONTAL WALL SYSTEM

BACKGROUND OF THE INVENTION

This invention relates generally, to the building construction industry and more particularly, to an improved wall system including columns adapted to be telescopically joined and having frame profiles of thin sheet-metal or extruded metal. The system includes cooperating wall panels with or without peripheral grooves.

The system advanced by the present invention applies to horizontal or vertical walls for houses or other buildings and which may be used for interior/exterior walls, floors, roofs or ceilings.

In general, the instant system comprises walls fabricated by a novel combination of columns formed of interconnecting components and which encompass appropriate panelling such as wall boards of well known construction. Individual wall sections when assembled are adapted to be joined by means of slidable and telescopic edge-pieces.

By the present arrangement an improved construction is provided which offers superior sound and fire insulation properties, in a manner not heretofore evident.

SUMMARY OF THE INVENTION

An object of the present invention is to provide an improved wall system including intermeshing frame profiles allowing of ready assembly while providing enhanced sound and fire insulation.

Another object of the present invention is to provide an improved wall system including profile elements surrounding a panel member and having pairs of disparate grooves with one type providing engagement with panel edges and the other type receiving splines serving to join adjacent profile elements and panels.

A further object of the present invention is to provide an improved wall system including panel sections presenting juxtaposed edge profile elements cooperating with splines allowing selective spacing between adjacent panel sections.

BRIEF DESCRIPTION OF THE DRAWING VIEWS

FIGS. 22-24 are fragmentary perspective views illustrating variations of assembled walls including both vertical and horizontal frame profiles.

Similar reference characters designate corresponding elements throughout the several figures of the drawings.

DESCRIPTION OF THE PREFERRED EMBODIMENTS

Figure 7:
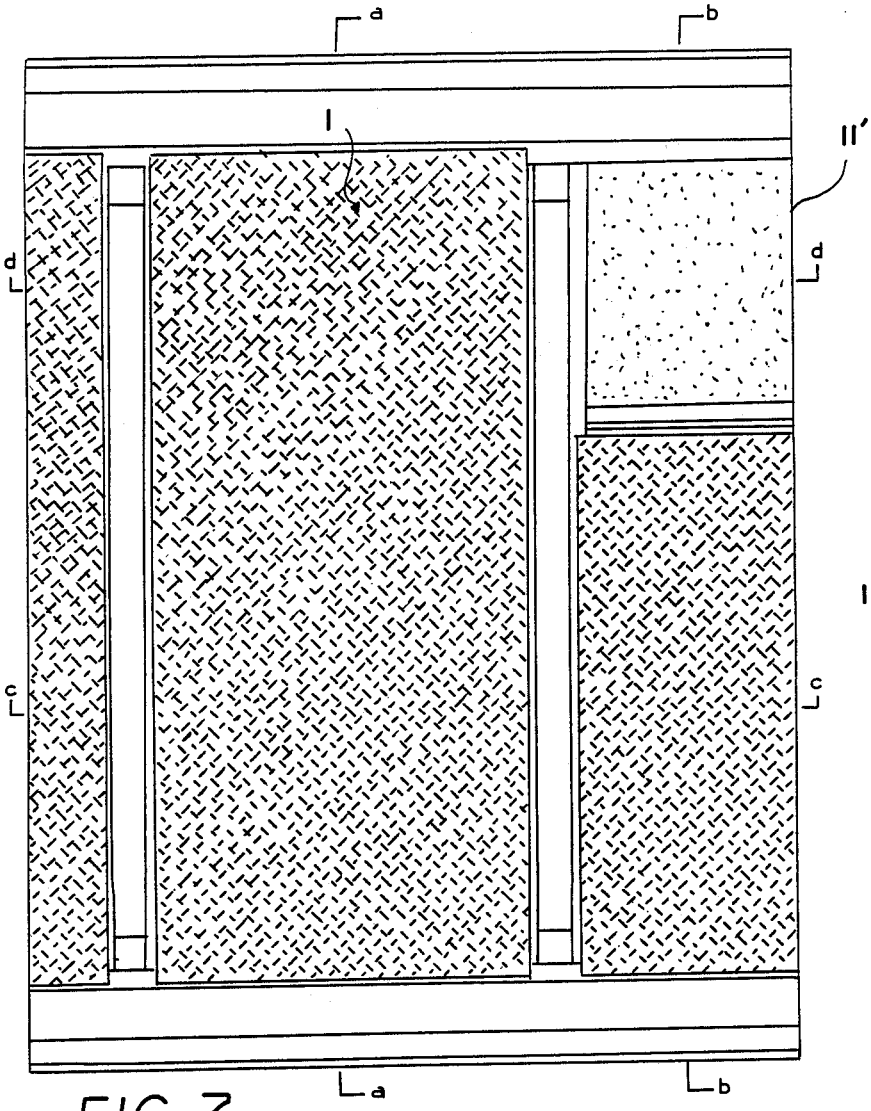
FIG. 7 is a fragmentary front elevation of a wall section according to the present invention.
Figure 8:
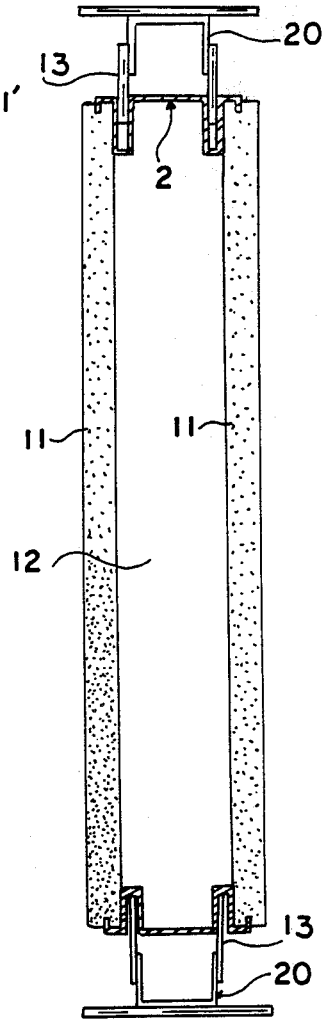
FIG. 8 is a vertical sectional view taken along the line a—a of FIG. 7.
Figure 9:
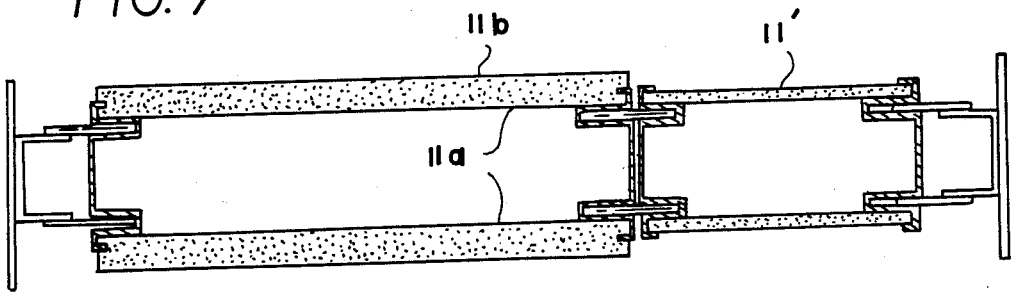
FIG. 9 is a vertical sectional view taken along the line b—b of FIG. 7.
Figure 10:
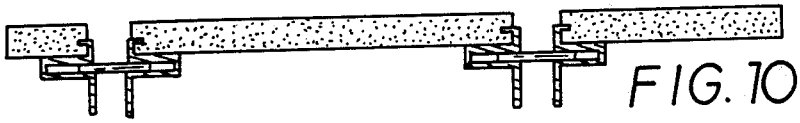
FIG. 10 is a horizontal sectional view taken along the line c—c of FIG. 7.
Figure 11:
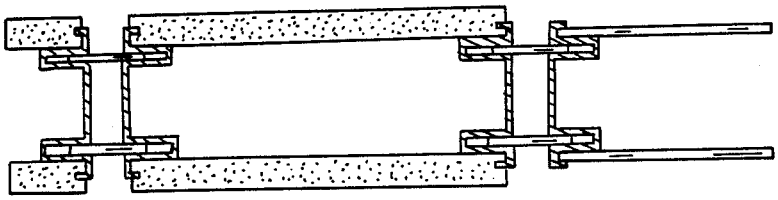
FIG. 11 is a horizontal sectional view taken along the line d—d of FIG. 7.
Figure 16:
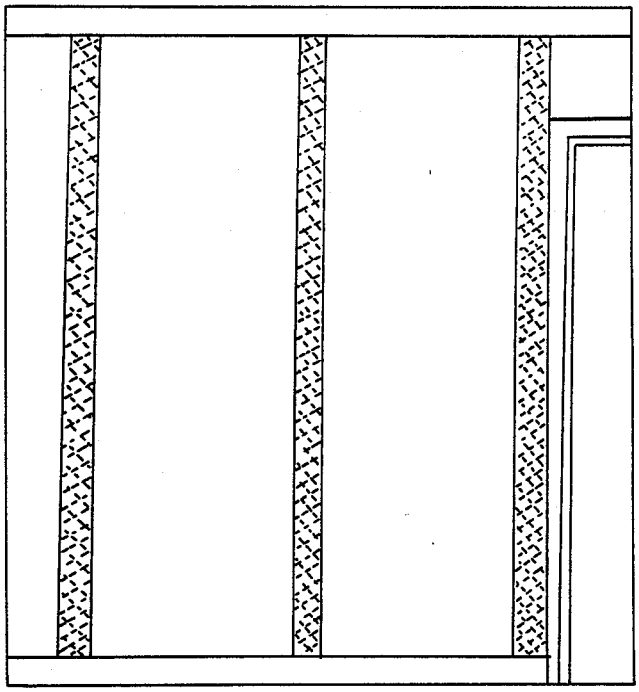
FIGS. 16 and 17 are front elevations of assembled walls according to the present invention.
Figure 17:
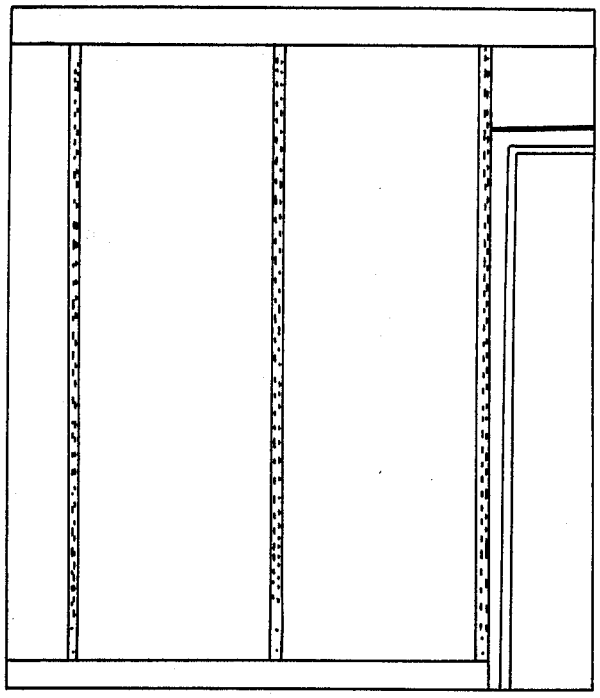
Figure 18:
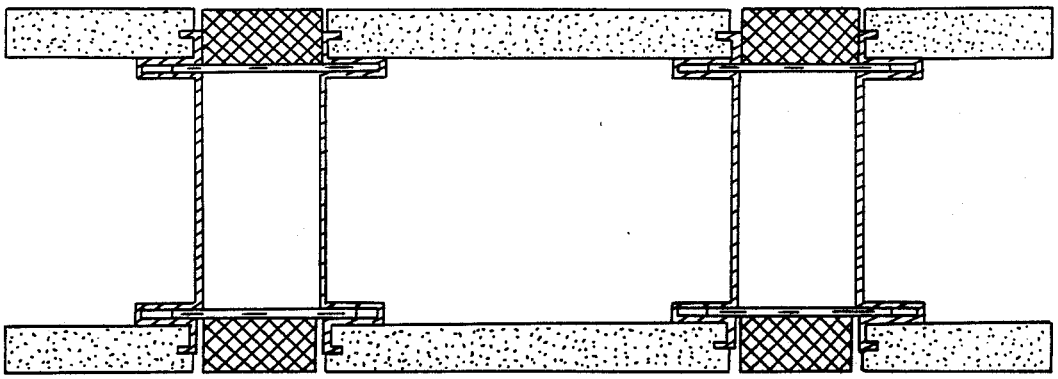
FIG. 18 is a top plan view of an assembled wall section.

The wall system of the present invention will be understood to comprise one or more wall sections 1 such as shown in FIGS. 7,16,17 each of which includes a frame defined by a plurality of frame profiles or elements 2, forming the horizontal as well as vertical peripheries. These profiles 2 serve not only to establish a thickness of each wall section 1 but also include distinct structure allowing ready assembly of each wall section itself as well as permit interconnection of adjacent ones of the wall sections.

Figure 6:
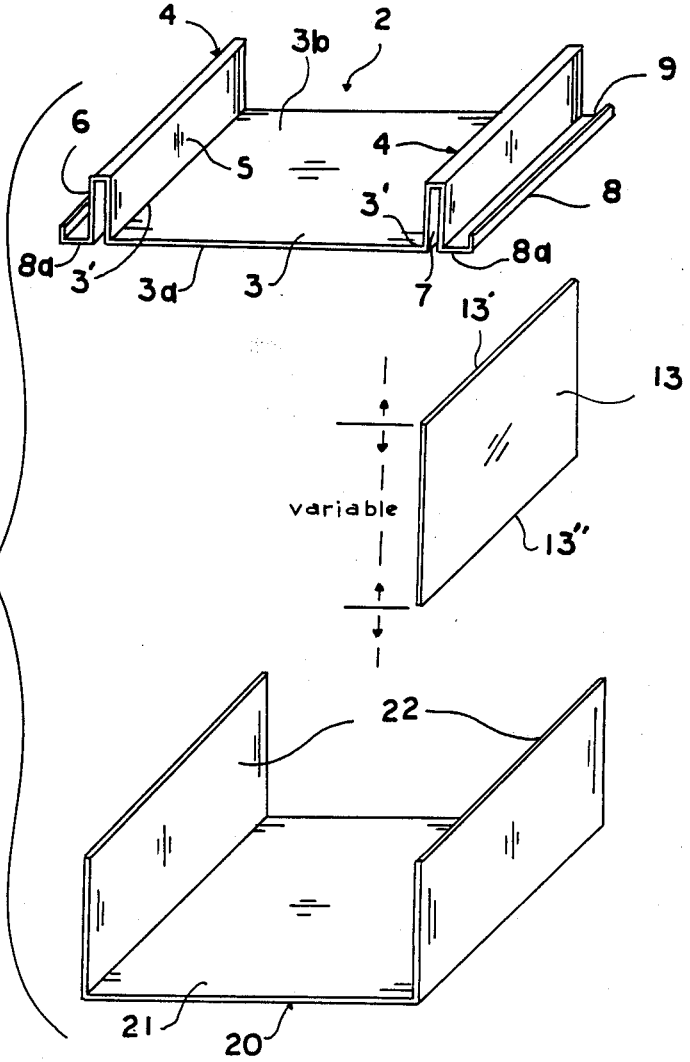
FIG. 6 is an exploded, perspective view of the principal components forming the profile of the columns.

The basic configuration of the frame profile 2 is shown most clearly in FIG. 6 of the drawings wherein it will be seen that this element comprises a central, planar web 3 bounded at its lateral edges 3'—3' by two large flanges 4—4 each formed by spaced apart inside and outside walls 5 and 6, respectively. These latter two walls are slightly spaced apart to define a deep yet narrow first groove 7 therebetween, accessible from the direction of the outer face **3*a* of the web 3. The distal edges of the profile are defined by small flanges 8—8, spaced outwardly from the large flanges 4 by base element 8*a* to provide a large second groove 9 which is shallower but wider than the grooves 7—7, and is accessible from the direction of the inner face 3*b* of the web 3**.

From the various assembly views of the drawings it will be apparent that each wall section 1 may be formed by placing the top or side peripheral edge 10 of a selected wallboard or panel member 11 within each of the large grooves 9. Accordingly, it will be seen that the dimension of the wall section interior 12 as well as the overall thickness of the wall section 1 will be determined by the spacing between the two large flanges 4 of the profiles 2.

Figure 1:
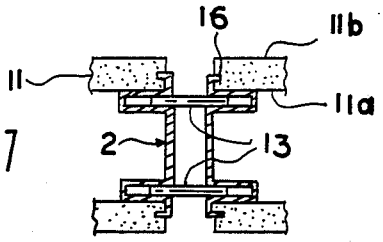
FIGS. 1-5 are fragmentary cross-sectional views illustrating alternate combinations of paneling elements with the column assembly of the present invention.
Figure 2:
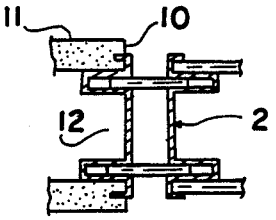
Figure 3:
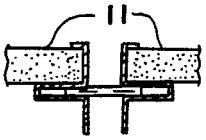

Adjacent wall sections 1 are further assembled in the manner such as shown in FIGS. 1-3 by the insertion of thin, planar splines 13 into the juxtaposed deep grooves 7,7 of opposed profile members of adjacent wall sections. These splines 13 will be understood to have a length comparable to that of the cooperating profile elements such that full isolation is achieved throughout the thickness of each wall section to enhance the sound and fire insulation capability of the assembly. In this respect, one edge 13' of each spline 13 is inserted, in a slip-fit manner, into the deep groove 7 of one profile, while the opposite edge 13'' of the same spline is similarly inserted into the juxtaposed deep groove 7 of the adjacent profile.

Figure 19:
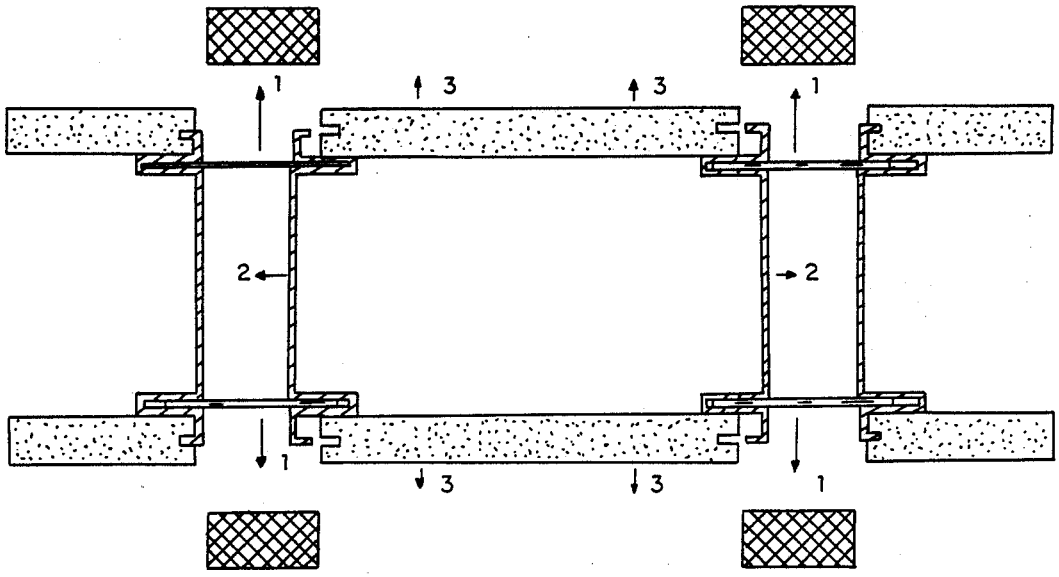
FIG. 19 is an exploded top plan view illustrating the sequence of dis-assembly of the wall section shown in FIG. 18.
Figure 20:
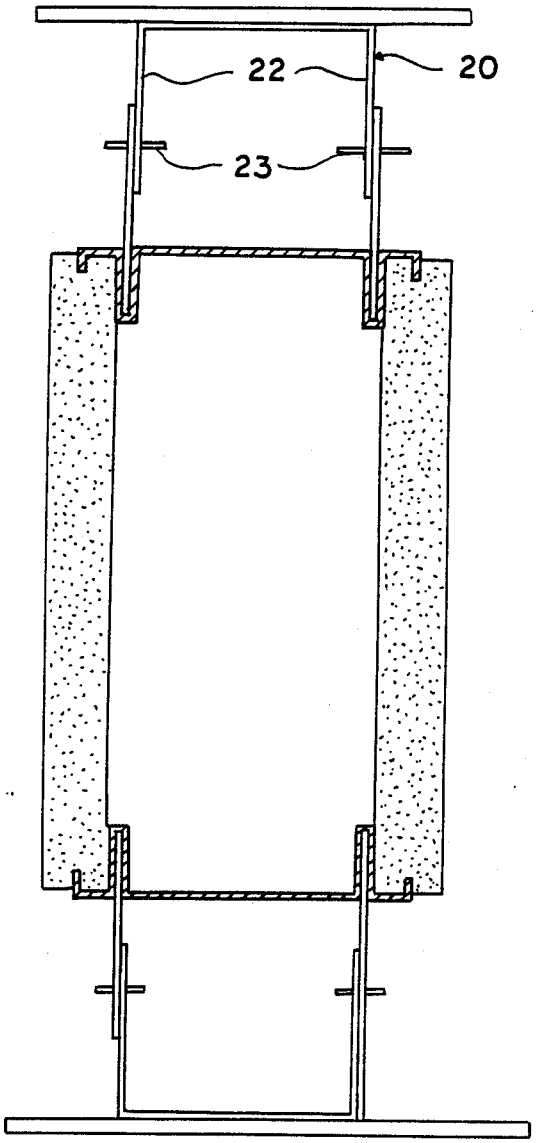
FIGS. 20 and 21 are vertical sectional views of alternate panel assemblies.
Figure 21:
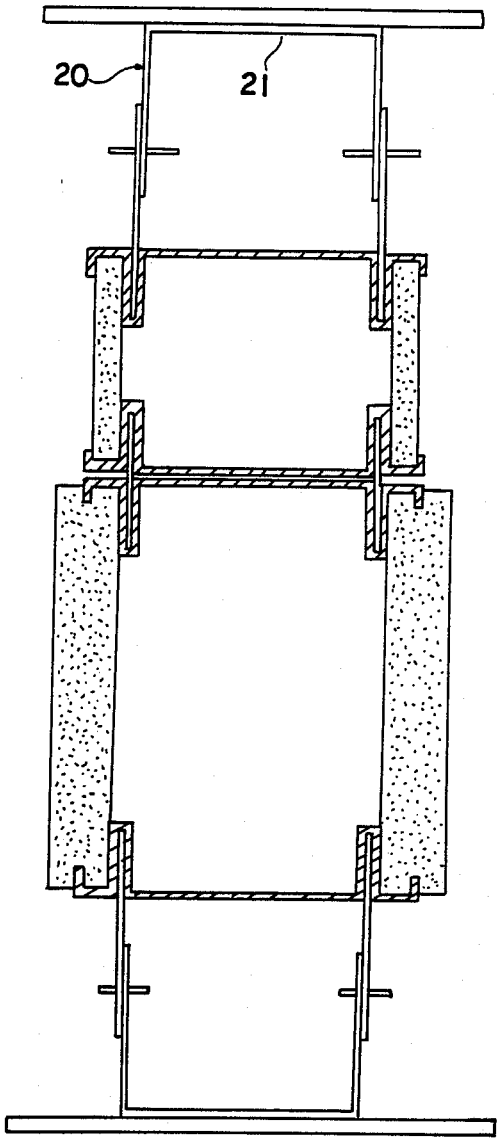

The depth of the large flange 4 is more than twice the depth of the small flange 8 while the width or distance between the edges 13', 13'' of the spline 13 connecting two opposed profiles is approximately equal to twice the depth of the small flange plus the desired distance between the two involved, juxtaposed frame profiles. With this arrangement, assembly and disassembly of the present invention is readily accomplished by following the sequence as depicted in FIG. 19 of the drawings.

Figure 12:
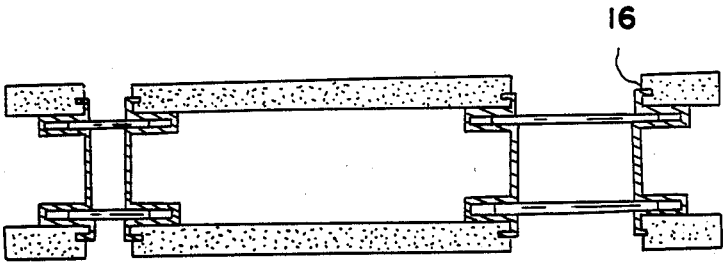
FIG. 12 is a fragmentary horizontal sectional view illustrating the ease by which the dimension of the metal profile columns may be varied.
Figure 13:
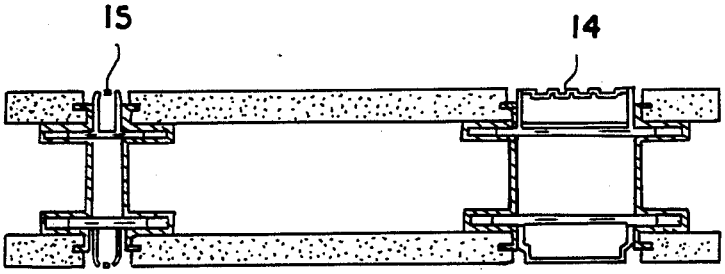
FIG. 13 is a view similar to FIG. 12 and illustrates the addition of functional or decorative components between adjacent wall panels.
Figure 14:
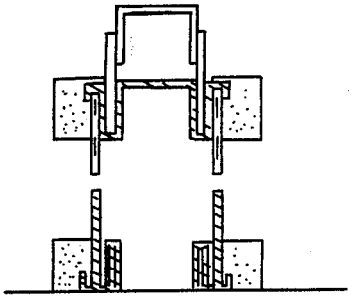
FIGS. 14 and 15 are sectional views of alternate trim members applied around glazed areas.
Figure 15:
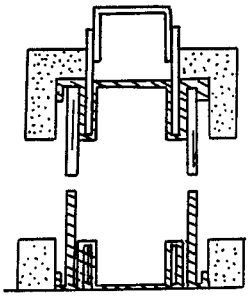

With the above described arrangement, various widths of splines 13 may be used to alter the lateral spacing between adjacent wall sections 1, as shown by the alternate spines utilized at opposite edges of the wall sections illustrated in FIGS. 12–13. With a wider spline, the space between adjacent profiles may be masked by the mounting of suitable decorative panels 14 as shown in FIGS. 13,16 while with a narrower spline as viewed in FIGS. 13,17, shelf mounting members 15 may be installed over the exposed splines.

Figure 4:
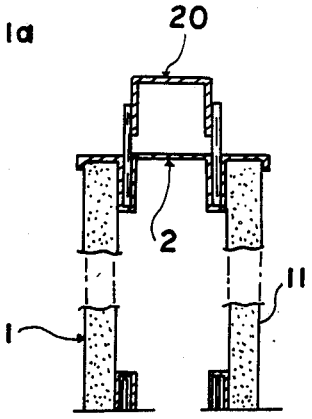
Figure 5:
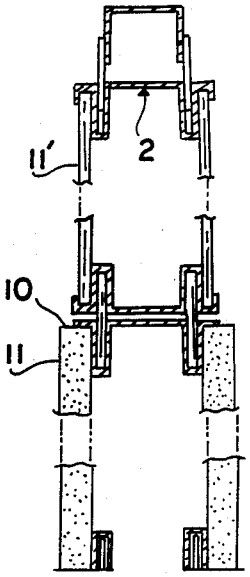

The width of the large wide grooves 9 of the profile may be of alternate dimensions. If it is desired to fully contain the edge 10 of a panel 11 within the confines of a groove 9, the small flange 8 is spaced from the large flange 4 a sufficient distance to closely contain the thickness of the panels 11 as in Figures 3,4,24 of the drawings. Alternately, the width of the large grooves 9 may be lesser, as in FIGS. 1,2,5,22 wherein it will be seen that the small flange 8 is spaced from the large flange 4 a distance to allow its insertion into a slot 16 provided in the medial portion of the panel edge 10.

The same profile element 2 serves to support various panel members such as shown in FIGS. 5,7,9,14,15,21 wherein alternate panels are assembled adjacent one another. In addition to wall boards 11, panels 11' of glass, plastics or other material of various thicknesses may be combined with the wall boards 22.

The slidable displacement of the profiles 2 readily permit the installation of various utilities such as electrical conduits, pipes or fixtures F as shown in FIG. 23.

Any wall section 1 may be secured in place through the use of the same splines 13, by means of a channel 20, such as shown in FIGS. 6,20–24. The base or web 21 of such channels will be understood to be suitable affixed relative the building structure with the two flanges 22—22 thereof disposed in planes parallel to the wall section. The splines 13 projecting from an edge of the wall section will be seen to form a close sliding engagement with the outside of the two channel flanges 22 and may be suitably secured thereto by appropriate fasteners as represented at 23 in FIG. 20.

From the foregoing, several advantageous points will be appreciated. With the frame as provided by the profile 2 surrounding all sides of every panel element of each wall section 1, the panels are easily installed or removed and when installed, are positively retained along their edges 10 as well as backed up along all their edges, by the outside walls 6 of the large flanges 4. This attachment, together with the splines 13 inter-fitting within the profile deep grooves 7, insures not only flexibility in the size and configuration of panel elements, but promotes an enhanced sound and fire insulation property to the wall system.

We claim:

1. A modular, selectively alterable wall system comprising;

a plurality of adjacent wall sections, each said wall section including a pair of spaced apart panel members each provided with inner and outer surfaces and having peripheral edges, a profile element engageable with laterally adjacent ones of said peripheral edges of each said pair of panel members of each said wall section, each said profile element including a substantially planar central web having inner and outer faces bounded by lateral edges and extending transversely of said pair of panel members, said web defining the majority width of said profile element, a U-shaped channel at each said web lateral edge normal to said web and projecting from said inner face, each said channel comprising inside and outside walls defining a first groove therebetween accessible from the direction of said web outer face, an outermost flange joined to each said channel outside wall by a base element and defining a second groove therebetween accessible from the direction of said web inner face, said second grooves having a width substantially greater than that of said first grooves, said outermost flanges parallel to said channel outside walls, said profile element second grooves engageable with said peripheral edges of said spaced apart pair of panel members of one said wall section with at least a portion of the thickness of each said panel member disposed between each said outermost flange and channel outside wall, a pair of rigid planar splines each having first and second opposite edges with said spline first edges respectively slidably disposed within said first grooves of one said profile element as engaged with said pair of panel members of one said wall section, said panel members in at least one of said plurality of wall sections comprising wallboards, said panel members in at least another one of said plurality of wall sections comprising glass, said second edges of said pair of splines slidably disposed within said first grooves of one said profile element of another, adjacent wall section, whereby, the distance between adjacent ones of said wall sections is variable depending upon the disposition of and dimension of said splines within respective ones of said first grooves.

2. A wall system according to claim 1 wherein, said first grooves have a depth substantially greater than that of said second grooves.

3. A wall system according to claim 1 wherein, said peripheral edges of said panel members include a slot therein intermediate said panel member inner and outer surfaces, and said profile element outermost flanges spaced from said channel outside walls a distance less than the thickness of said panel members and engageable within said panel member slots, whereby only a portion of said panel member peripheral edges are engaged within said profile element second grooves.

4. A wall system according to claim 1 wherein, said profile element comprises a structurally integral element.

5. A wall system according to claim 1 including, a trim member overlying said spline intermediate said panel members of adjacent ones of said plurality of wall sections.

6. A wall system according to claim 1 including, a shelf mounting member overlying said spline intermediate said panel members of adjacent ones of said plurality of wall sections.

* * * * *